US005655447A

United States Patent [19]

De Volder

[11] Patent Number: 5,655,447

[45] Date of Patent: Aug. 12, 1997

[54] PRINTING ARRANGEMENT

[76] Inventor: Laurent De Volder, Aalterstraat 11, B-9880 Maria-Aalter, Belgium

[21] Appl. No.: 433,122

[22] Filed: May 3, 1995

[30] Foreign Application Priority Data

May 6, 1994 [BE] Belgium ..... 09400474

[51] Int. Cl.[6] ..... B41F 5/00

[52] U.S. Cl. ..... 101/216; 101/349; 101/350

[58] Field of Search ..... 101/213, 216, 101/217, 218, 219, 228, 247, 248, 348, 349, 350, 329, 330, 331

[56] References Cited

U.S. PATENT DOCUMENTS

| | | | |
|---|---|---|---|
| 1,074,004 | 9/1913 | Moon et al. | 101/228 |
| 1,208,642 | 12/1916 | Pitney | 101/228 |
| 1,330,793 | 2/1920 | Friess | 101/247 |
| 1,417,652 | 5/1922 | Wood | 101/219 |
| 1,957,291 | 5/1934 | Rees | 101/228 |
| 2,160,613 | 5/1939 | Crafts | 101/247 |
| 2,982,204 | 5/1961 | Roehm | 101/247 |
| 3,167,008 | 1/1965 | Edgeley et al. | 101/228 |
| 3,638,568 | 2/1972 | Granger | 101/247 |
| 3,793,952 | 2/1974 | Neumann et al. | 101/216 |
| 4,252,059 | 2/1981 | Simeth | 101/247 |

*Primary Examiner*—Eugene H. Eickholt
*Attorney, Agent, or Firm*—Spencer & Frank

[57] ABSTRACT

Printing arrangement, characterized in that it consists in the combination of a frame (2), a printing roller (3) mounted rotatably in the frame (2); an ink roller (4) cooperating with the printing roller (3); and coupling means (5) for making the printing roller (3) cooperate with an external drive.

7 Claims, 5 Drawing Sheets

PRINTING ARRANGEMENT

This invention relates to a printing arrangement.

More particularly, the invention relates to a printing arrangement which is intended to print all kinds of materials, such as paper, cardboard, wood, rubber, textile, all kinds of synthetic films, aluminium foils, steel plates, aluminium plates, inox plates, etc.

The invention is in particular intended to print products on regular distances with information and/or a logo and/or a trade mark. Typical applications thereof are the bottom side of wall paper, the bottom side of floor coverings, cement plates and asphalt products.

SUMMARY OF THE INVENTION

The invention has for object to offer an arrangement which is extremely suited for printing the above products at a low cost.

To this end, the invention concerns a printing arrangement which comprises in combination, a frame; a printing roller mounted rotatably in the frame; an ink roller cooperating with the printing roller; and coupling means for making the printing roller cooperate with an external drive.

Due to the fact that use is made of coupling means for making the printing roller cooperate with an external drive, the printing arrangement can be built directly onto a production machine of the product to be printed so that the use of large separate rotary flexo printing machines can be omitted without loss of quality. The printing quality of the arrangement according to the invention is very high and even better than the so-called flexo printing.

According to a first embodiment of the invention, the coupling means includes of one or more elements which may be brought into contact with a moving material to be printed, and which make the printing roller rotate by virtue of this contact. These coupling means may include at least one contact ring which cooperates with the circumference of the printing roller. These coupling means offer the advantage of being of a simple construction and of allowing the use of a motor to be dispensed with.

According to a second embodiment of the invention, the coupling means include a motor for driving the printing roller; a detection arrangement for following the movement of the material to be printed; and control means which control the motor as a function of the movement observed by the detection means. Preferably. the detection means include a tachometer coupled to an existing drive element which drives the material to be printed, and the motor includes a servomotor controlled as a function of the signal generated by the tachometer.

According to yet another embodiment, the coupling means include a mechanical transmission means, such as a gear wheel coupling, between a roller or other similar element which rotates simultaneously with the movement of the material to be printed and of the printing roller.

BRIEF DESCRIPTION OF THE DRAWINGS

With a view to better demonstrate the characteristics according to the invention, some preferred embodiments are described hereinafter by way of examples without limiting the invention and with reference to the annexed drawings wherein.

DETAILED DESCRIPTION OF THE INVENTION

Figure 1:
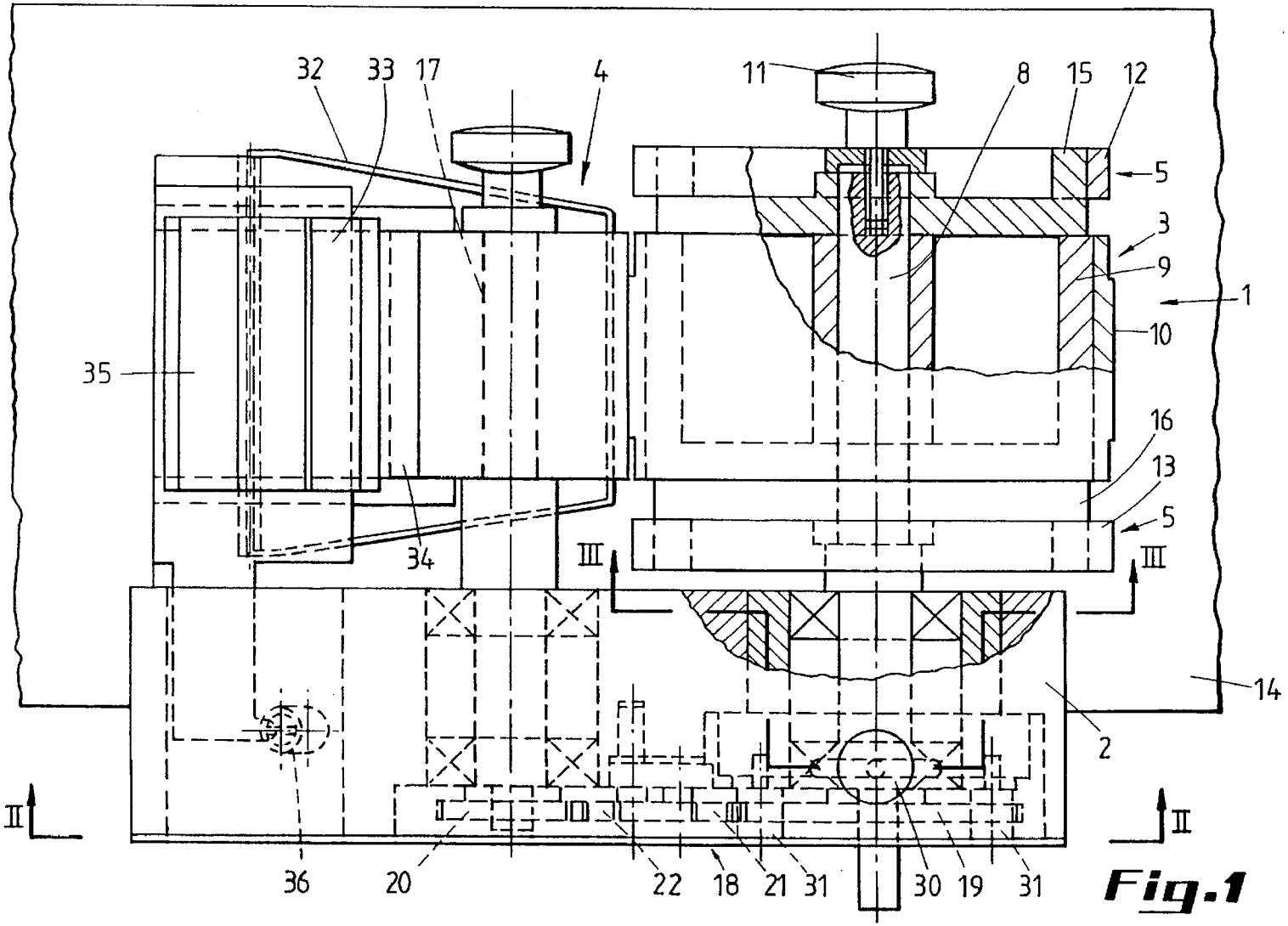
FIG. 1 shows a top partially sectional view of a printing arrangement according to the invention.
Figure 2:
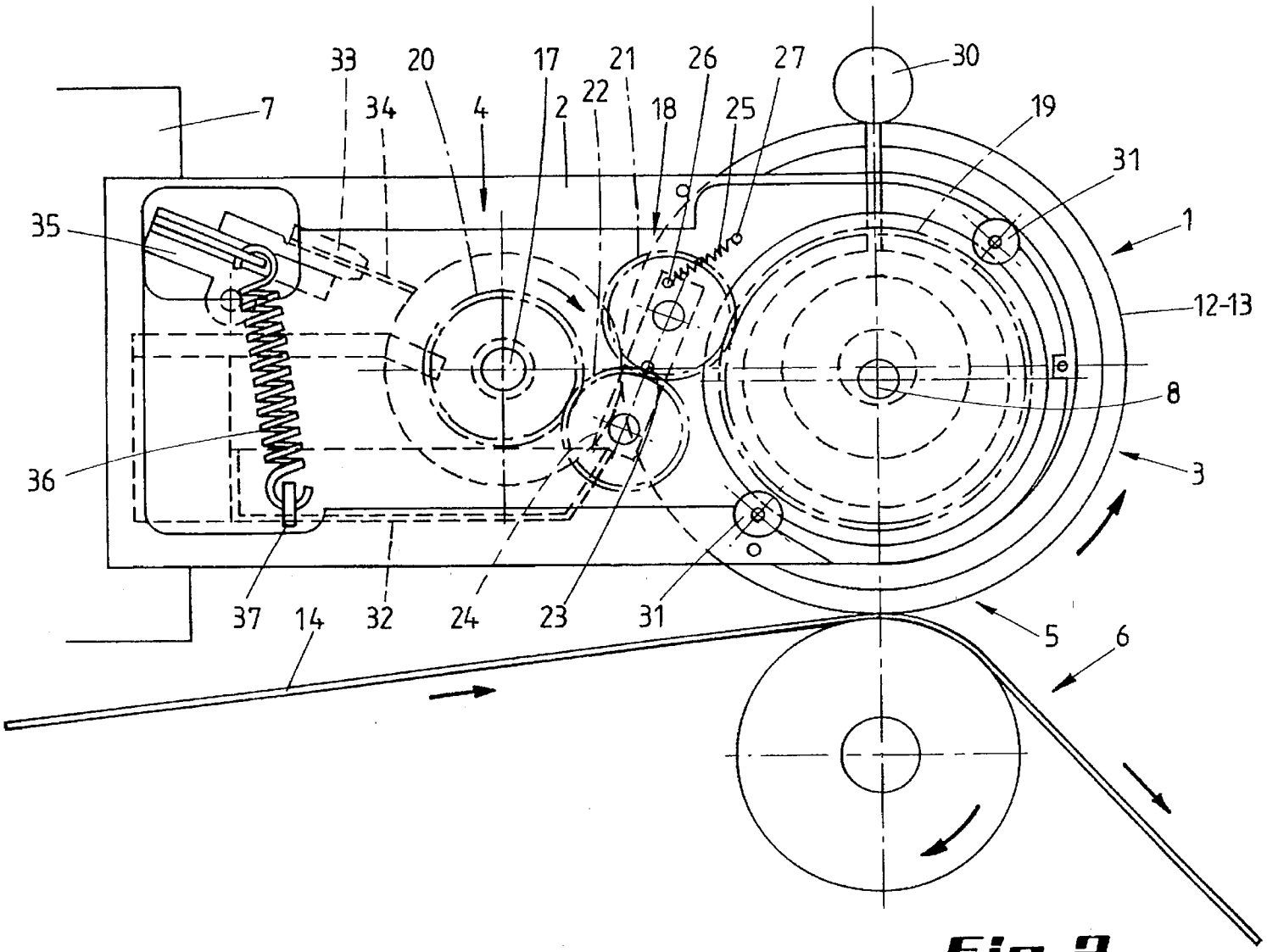
FIG. 2 shows a cross section along line II—II in FIG. 1.

As shown in FIGS. 1 and 2, the invention relates to a printing arrangement 1 which includes the combination of a frame 2; a printing roller 3 mounted rotatably in the frame 2; an ink roller 4 cooperating with the printing roller 3; and coupling means 5 for allowing the printing roller 3 to cooperate with an external drive 6. In the shown example, the frame 2 is attached to the framework 7 of an existing machine (see FIG. 2).

The printing roller 3 includes a cylinder 9 mounted onto the shaft 8 and provided with a cliche 10. This printing roller 3 is exchangeable because the cylinder 9 can be made to slide off the shaft 8, respectively mounted thereon, and can be locked thereon by means of a locking knob 11. The cliche 10 consists preferably of rubber or of a polymer.

The ink roller 4 preferably includes either a steel cylinder which is copper-plated, then screen printed and subsequently chromium-plated, or a steel cylinder which is covered with ceramics, polished and screen printed with a laser.

Coupling means 5 includes a number of elements, and, in this case, two contact rings 12 and 13, which can be brought into contact with the moving material 14 to be printed (see FIG. 2) so that the printing roller 3 is thereby rotated.

The contact rings 12 and 13 may be made of rubber or the like and can be mounted on separate disks 15 and 16 so that they may cooperate with different printing rollers 3 of the same diameter. The disks 15 and 16 are mounted onto the shaft 8 together with the cylinder 9.

The ink roller 3 is freely rotatable about a shaft 17 applied in the frame 2.

In order to prevent slip between the printing roller 3 and the ink roller 4, they are preferably coupled to one another, which coupling is achieved in the shown embodiment by means of a gear wheel coupling 18.

Preferably, as shown in FIGS. 1 and 2, the printing roller 3 and the ink roller 4 are mutually coupled by means of a coupling which permits a mutual displacement between the shafts 8 and 17 of the printing roller 3 and the ink roller 4. In this way, it is possible to adjust the pressure between the printing roller 3 and the ink roller 4, or possibly to adjust the distance as a function of the diameter of the used printing roller 3 and/or ink roller 4.

The above coupling, in this case the gear wheel coupling 18, includes a gear wheel 19 which is coupled to the printing roller 3; a gear wheel 20 which is coupled to the ink roller 4; and a number of mutually engaging gear wheels 21–22 which are mounted rotatably on an arm 24 which is pivotable around an axis 23, which gear wheels 21–22 can engage both in the gear wheel 19 which is coupled with the printing roller 3 and the gear wheel 20 which is coupled with the ink roller 4 by pivoting the pivotable arm 24; and resilient means 25 which exert a pressure onto the pivotable arm 24 such that the gear wheels 21–22 mounted on the arm 24 always engage in the two former gear wheels 19–20. The resilient means 25 include for example of a tension spring applied between the extremity 26 of the arm 24 and a fixed point 27 of the frame 2.

Figure 3:
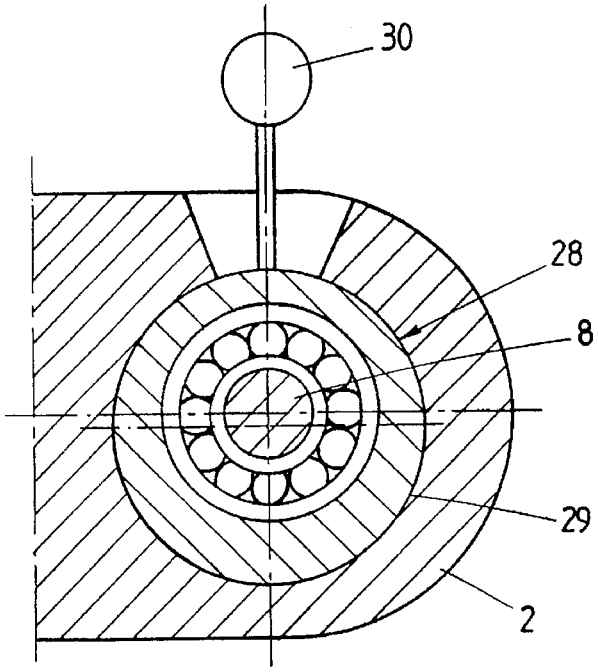
FIG. 3 shows a schematic cross section along line III—III in FIG. 1.

As shown in FIG. 3, the printing arrangement 1 is preferably further provided with adjustment means 28 for adjusting the position of the printing roller 3 with respect to the frame 2, and thus also with respect to the ink roller 4, so as to adjust the pressure between the printing roller 3 and the ink roller 4 in a simple way. As shown in FIG. 3, the adjustment means 28 consist preferably include an eccentric 29 in which the shaft 8 is supported and which is adjustable under different angles. The eccentric 29 can be adjusted by means of a lever 30 and can be locked in any arbitrary position by means of locking elements 31 as shown in FIG. 2.

The ink is preferably supplied by means of an ink well 32 which is disposed to have the bottom side of the ink roller 4 immersed into the ink. The superfluous ink is preferably removed by means of a doctor blade 33 which is pressed against the ink roller 4. The doctor blade 33, which is provided with a knife 34, can be mounted onto a pivotable doctor blade holder 35 which is pressed, together with the knife 34, by means of resilient means, such as a tension spring 36, onto the ink roller 4.

The power of the resilient means is preferably adjustable, for example due to the fact that the attachment point 37 of the tension spring 36 to the frame 2 can be relocated.

It is clear that the whole is suspended in such a manner that the printing roller 3 pushes with a suitable pressure onto the material 14 which is to be printed.

The operation of the printing arrangement 1 shown in FIGS. 1 to 3, can be deduced simply from these figures.

Due to the fact that the contact rings 12 and 13 make contact with the material 14 to be printed, the printing roller 3 rolls over this material 14. The ink roller 4 is driven by means of the gear wheel coupling 18 and applies ink from the ink well 32 onto the cliche 10 on the printing roller 3. The image of the cliche is thereby printed onto the material 14.

Figure 4:
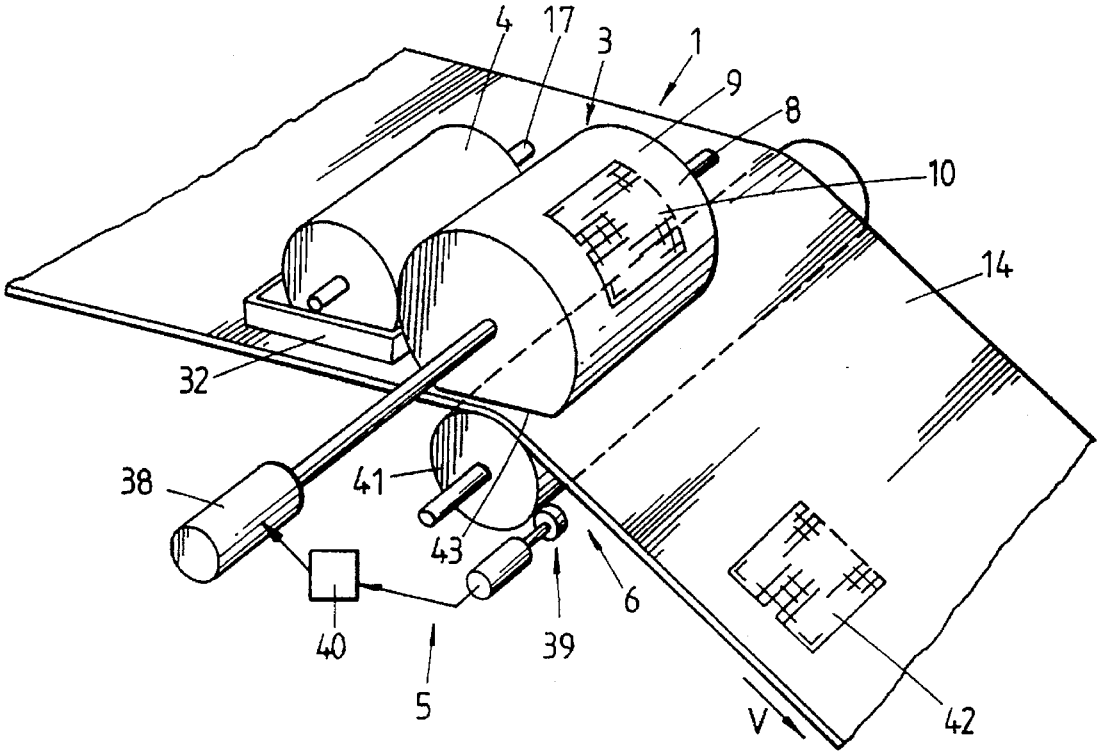
FIG. 4 shows a schematic perspective view of a further printing arrangement according to the invention.

FIG. 4 shows schematically a variant of the invention wherein the coupling means 5 consist of a motor 38 for driving the printing roller 3; detection means 39 for following the movement of the material 14 to be printed; and control means 40 which control the motor 38 as a function of the movement V observed by means of the detection means 39. The detection means 39 may cooperate either directly with the material 14 to be printed or, as shown in FIG. 4, with a guide or drive roller 41 for the material 14. In FIG. 4, these detection means 39 includes a tachometer, while the motor 38 includes a servomotor. The servomotor is normally driven in such a manner that the peripheral velocity of the printing roller 3 is equal to the travelling speed of the material 14.

According to a particular embodiment of the invention, the printing arrangement 1 will also be provided with means for making the printing roller 3 pivot intermittently, so that it is for example possible to repeat the image 42 to be printed over mutual distances which are greater than the circumference of the printing roller 3.

The embodiment of FIG. 4 is particularly suited for the above embodiment, since the motor 38 can be actuated simply in an intermittent way, for example by way of the control means 40, so that the printing roller 3 performs, in between intervals of time, at each revolution therefore. In order to ensure that the printing roller 3 does not contact material 14 during the above intervals of, it is provided with a cut away portion 43.

Figure 5:
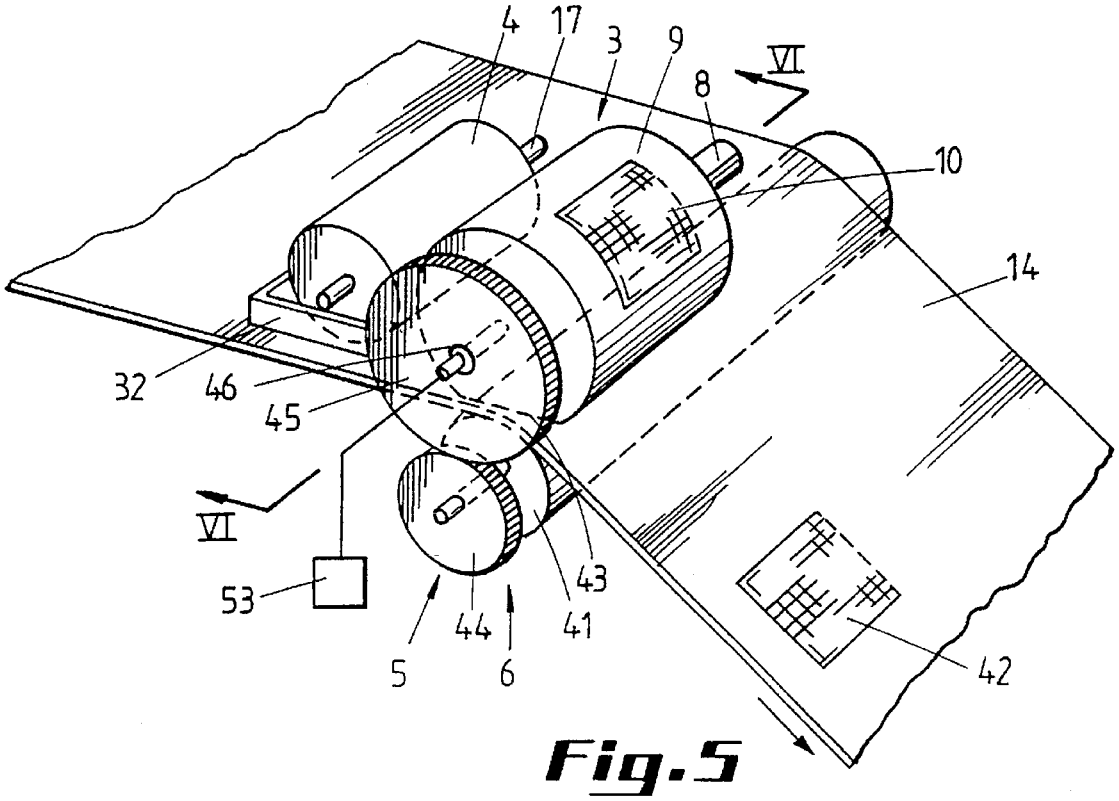
FIG. 5 shows a schematic perspective view of yet a further printing arrangement according to the invention.
Figure 6:
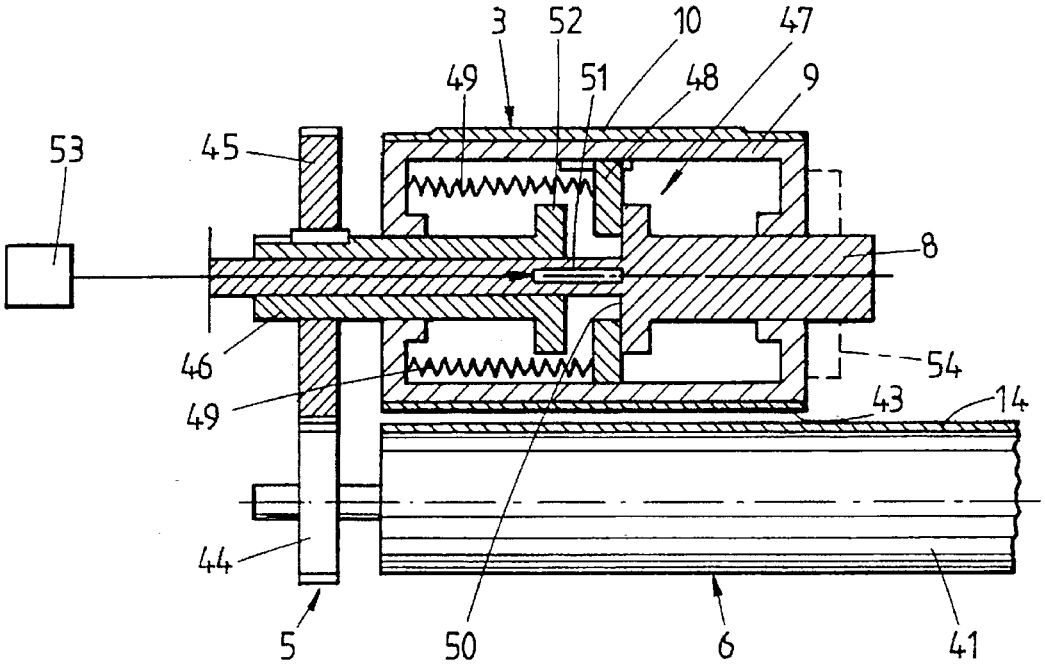
FIG. 6 shows a cross-section along line VI—VI in FIG. 5.

FIGS. 5 and 6 show a variant wherein the coupling means 5 are formed by a mechanical transmission, in this case a gear transmission, between the guide roller 41 and the printing roller 3. The gear transmission is formed herein of a first gear wheel 44 which is coupled to the existing roller 41 and a second gear wheel 45 which is coupled to a shaft 46 which can cooperate with the printing roller 3, the transmission being such that the rotational velocities of the roller 41 and the printing roller 3 are equal to each other during the rotation of the printing roller 3.

The means for making the printing roller 3 pivot intermittently, can, in addition, be formed by a controlled clutch which, depending on the controlled position, makes the printing roller 3 pivot or stop as needed. As shown in FIG. 6, a brake clutch 47 may be used to achieve the above the printing roller 3 being driven in the connected state of the brake clutch 47 by the gear wheels 44 and 45 and held in a stand still position in the unpowered state of the brake clutch 47.

The brake clutch 47 can be configured in different ways. In the schematic representation of FIG. 6, the cylinder 9 is provided with a clutch part 48 which is axially slidable but not rotatable with respect to the cylinder 9. In standstill or rest position, the clutch part 48 is pushed by means of springs 49 against a fixed, immobilized brake surface 50, but can be moved by means of an electromagnet 51 against the pressure of the springs 49 so as to be pushed against a part 52 which rotates simultaneously with the gear wheel 45 and the shaft 46. It is clear that the printing roller 3 stands still in the unpowered state of the electromagnet 51 and that it will rotate together with the shaft 46 when powered. This powering can be achieved by way of control means 53.

The printing roller 3 is preferably stopped while the cut away 43 is directed toward the material 14. Further use can be made of detection means 54 providing a detection which causes the printing roller 3 to stop after each rotation and to perform a subsequent rotation only after receipt of a new power signal.

Although the embodiments of FIGS. 4 and 5–6 are particularly appropriate for an intermittent drive of the printing roller 4, they do not exclude the additional provision of intermittently driven printing arrangements 1, which are driven, as shown in FIGS. 1 to 3, by means of contact rings 12–13.

The printing arrangement 1 according to the invention permits the use of extra fast drying inks having a strong pigmentation for use on porous and non porous surfaces.

The arrangement can include different printing rollers 3, having the desired diameter and printing width. Optionally, several printing arrangements 1 can be disposed in line, which arrangements may include a common frame 2, whereby multicolor printing can be achieved.

Figure 7:
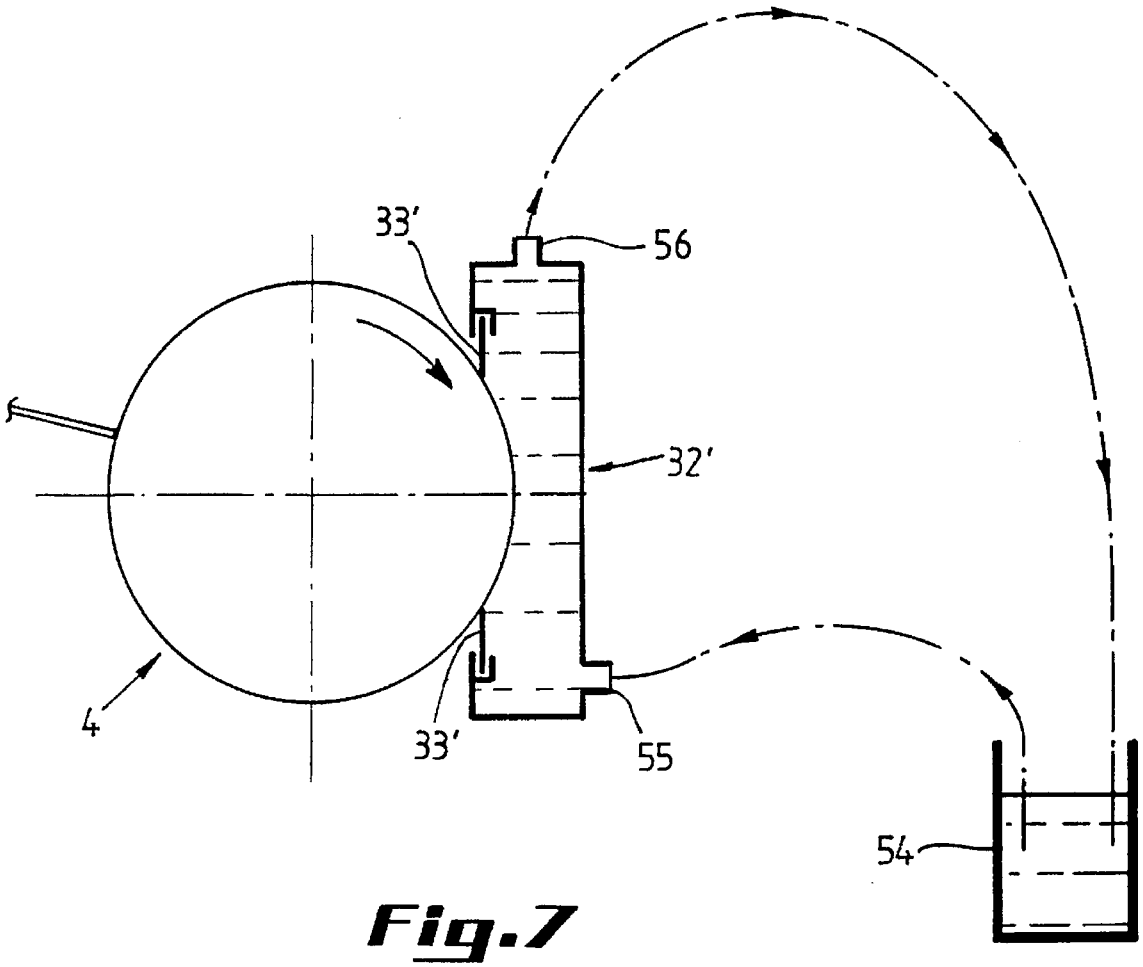
FIG. 7 is a cross-sectional view of an ink chamber, according to a variant of the invention.

According to the embodiment of FIG. 7, the ink can also be applied onto the ink roller 4 by making use of an ink chamber 32' which is pushed radially against the ink roller 4. The ink chamber 32' includes a window facing the ink roller, the opening of which is determined by upper and lower doctor blades 33'. In order to prevent air bubbles in the ink chamber 32' from causing an irregular spreading of the ink on the ink roller 4, a continuous ink circulation is maintained in this ink chamber. The above is achieved by creating from an ink reservoir 54 a continuous flow of ink between an inlet 55 and an outlet 56 of the ink chamber. The ink chamber shown in FIG. 5:

ensures a perfect inking of a large surface;

makes splashing of ink at high speeds impossible;

limits drying of the ink;

reduces the spreading of smells to a minimum;

uses the printing machine in all directions which ensures a large flexibility thereof.

It is clear that by ink the description refers to any product which enables the application of an image by means of the printing roller 3, such as lacquers, paints and the like.

I claim:

1. Printing arrangement, comprising a combination of a frame; a printing roller mounted rotatably in the frame; an ink roller cooperating with the printing roller; and coupling means for making the printing roller cooperate with an external drive, the printing roller and the ink roller being mutually coupled by means of a coupling which allows a mutual displacement of the shafts of the printing roller and the ink roller, said coupling comprising a first gear wheel which is coupled to the printing roller, a second gear wheel which is coupled to the ink roller, a number of mutually engaging gear wheels which are rotatably mounted onto a pivotable arm, which mutually engaging gear wheels may engage by the pivoting of the pivotable arm both into the first gear wheel coupled to the printing roller and into the second gear wheel coupled to the ink roller, and resilient means exerting such a force onto the pivotable arm that said mutually engaging gear wheels mounted on said arm always engage the first and the second gear wheels.

2. Printing arrangement as claimed in claim 1, wherein the printing roller is exchangeable.

3. Printing arrangement as claimed in claim 1, comprising a doctor blade which cooperates with the ink roller.

4. Printing arrangement as climaxed in claim 3, wherein the doctor blade is mounted on a further pivotable arm and is pressed against the ink roller by means of a spring.

5. Printing arrangement as claimed in claim 1, comprising an ink well for supplying ink to the ink roller.

6. Printing arrangement as claimed in claim 1, comprising an ink chamber having a window extending between doctor blades, which ink chamber is kept under a radial pressure against the ink roller.

7. Printing arrangement as claimed in claim 6, wherein means are provided for circulating ink from an ink reservoir between an inlet and an outlet of the ink chamber.

* * * * *